US005755089A

United States Patent [19]

Vanselow

[11] Patent Number: 5,755,089

[45] **Date of Patent: *May 26, 1998**

[54] METHOD AND APPARATUS FOR OPERATING A GAS AND STEAM TURBINE PLANT USING HYDROGEN FUEL

[75] Inventor: Walter Vanselow, Heroldsbach, Germany

[73] Assignee: Siemens Aktiengesellschaft, Munich, Germany

[21] Appl. No.: 716,855

[22] Filed: Sep. 17, 1996

Related U.S. Application Data

[63] Continuation-in-part of PCT/DE95/00283, Mar. 3, 1995 published as WO95/25219, Sep. 21, 1995.

[30] Foreign Application Priority Data

Mar. 17, 1994 [DE] Germany ..... P 44 09 196.6

[51] Int. Cl.[6] ..... F02C 3/28; F02C 6/18

[52] U.S. Cl. ..... 60/39.05; 60/39.12; 60/39.182

[58] Field of Search ..... 60/39.02, 39.05, 60/39.12, 39.182, 39.465

[56] References Cited

U.S. PATENT DOCUMENTS

| | | | |
|---|---|---|---|
| 4,148,185 | 4/1979 | Somers | 60/39.17 |
| 5,331,806 | 7/1994 | Warkentin | 60/39.465 |
| 5,644,911 | 7/1997 | Huber | 60/39.465 |

FOREIGN PATENT DOCUMENTS

| | | |
|---|---|---|
| 0 148 973 B1 | 7/1985 | European Pat. Off. . |
| 0 523 467 A1 | 1/1993 | European Pat. Off. . |
| 2 034 412 | 6/1980 | United Kingdom . |

OTHER PUBLICATIONS

"Prompt reserve steam generator supports the electric circuit", BWK, vol. 41 (Jun. 1989), No. 6, p. 287.

"Hydrogen/Oxygen Steam Generator in power technology", (Sternfeld), VDI Reports, No. 602, 1987, pp. 231–247.

*Primary Examiner*—Louis J. Casaregola
*Attorney, Agent, or Firm*—Herbert L. Lerner; Laurence A. Greenberg

[57] ABSTRACT

A method for operating a gas and steam turbine plant includes utilizing heat contained in an expanded working medium from a gas turbine to generate steam for a steam turbine connected into a water/steam circuit. The working medium for the gas turbine is generated by combustion of a fuel along with a supply of compressed air. In order to increase efficiency of the plant, the generated steam, before being introduced into the steam turbine, is superheated through the use of heat occurring during hydrogen/oxygen combustion. The plant includes a waste-heat steam generator which is located downstream of the gas turbine on the exhaust-gas side and in which a number of heating surfaces connected into the water/steam circuit of the steam turbine are disposed. A hydrogen/oxygen burner is connected into the water/steam circuit between the waste-heat steam generator and the steam turbine.

10 Claims, 1 Drawing Sheet

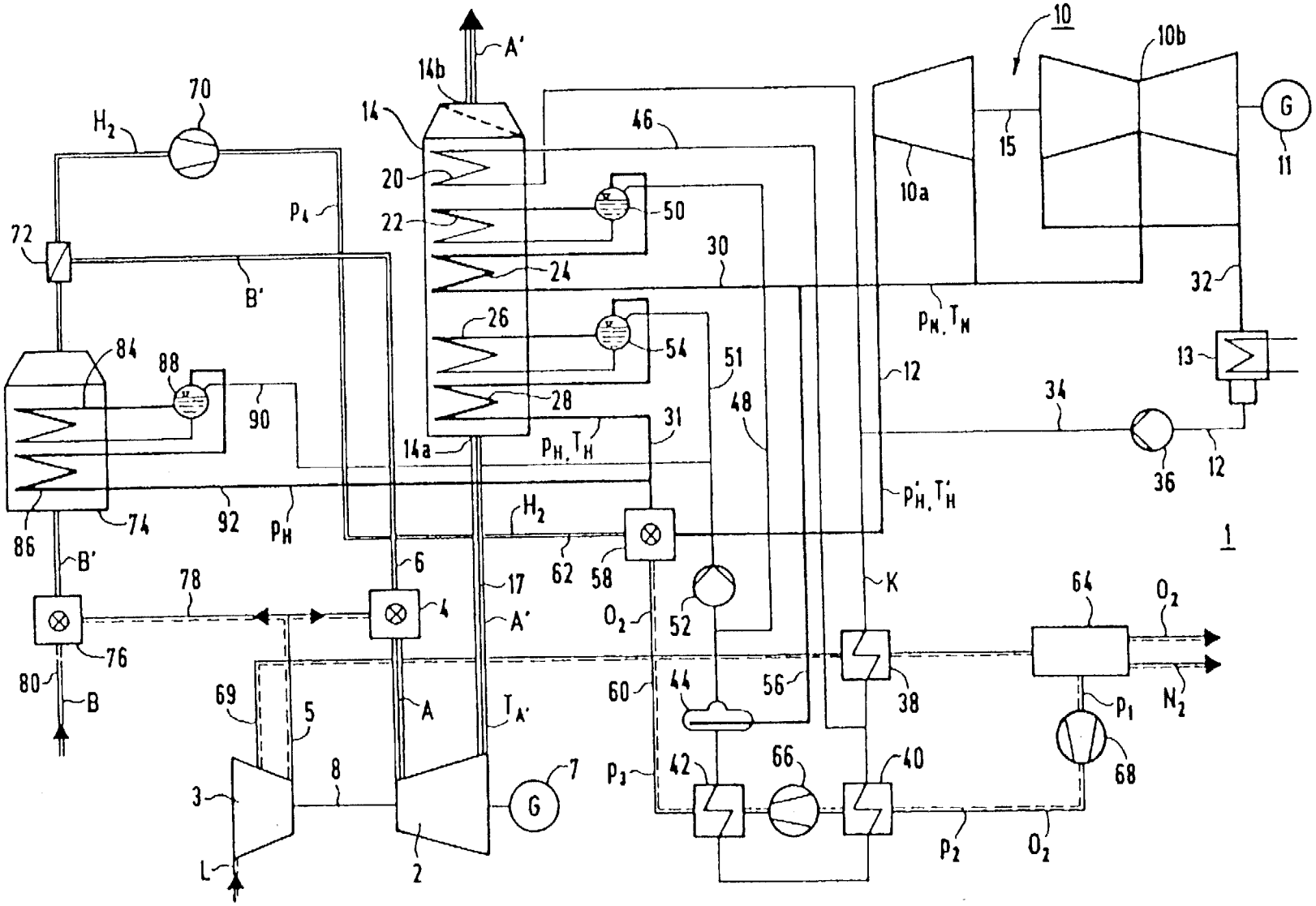
G
11
10b
10
10a
15
32
13
12
36
34
1
$O_2$
$N_2$
64
$p_1$
68
$O_2'$
$p_2$
$p_W, T_W$
$p_H', T_H'$
K
38
40
66
56
48
51
30
46
50
54
31
52
44
42
58
60
$p_3$
$p_H, T_H$
62
$H_2$
17
A'
$T_{A'}$
7
G
A'
14b
14
20
22
24
26
28
14a
6
4
A
2
8
5
69
3
L
$p_4$
B'
90
$p_H'$
92
70
88
78
$H_2$
84
74
76
B'
B
72
86
80

METHOD AND APPARATUS FOR OPERATING A GAS AND STEAM TURBINE PLANT USING HYDROGEN FUEL

CROSS-REFERENCE TO RELATED APPLICATION

This application is a Continuation of International Application Serial No. PCT/DE95/00283, filed Mar. 3, 1995 published as WO95/25219, Sep. 21, 1995.

BACKGROUND OF THE INVENTION

FIELD OF THE INVENTION

The invention relates to a method for operating a gas and steam turbine plant, in which heat contained in an expanded working medium from a gas turbine is utilized to generate steam with a steam turbine connected into a water/steam circuit. At the same time, the working medium for the gas turbine is generated by combustion of a fuel along with a supply of compressed air. The invention also relates to a gas and steam turbine plant working according to the method.

In such a gas-turbine and steam-turbine plant, the heat contained in the expanded working medium from the gas turbine is utilized to generate steam for the steam turbine. The heat transmission takes place in a steam generator or waste-heat boiler which is located downstream of a gas turbine and in which heating surfaces in the form of tubes or tube bundles are disposed. They are in turn connected into the water/steam circuit of the steam turbine. The water/steam circuit includes a plurality of pressure stages, for example two, with each pressure stage having a preheating, an evaporating and a superheating heating surface. Through the use of a gas-turbine and steam-turbine plant of that type which is known, for example, from European Patent 0 148 973 B1, a thermodynamic efficiency of approximately 50% to 55%, depending on the pressure conditions prevailing in the water/steam circuit of the steam turbine, is achieved.

SUMMARY OF THE INVENTION

It is accordingly an object of the invention to provide a method for operating a gas and steam turbine plant and a plant working according to the method, which overcome the hereinafore-mentioned disadvantages of the heretofore-known methods and devices of this general type, in which the method achieves an increased efficiency and in which the plant is particularly simple.

With the foregoing and other objects in view there is provided, in accordance with the invention, a method for operating a gas and steam-turbine plant, which comprises generating a working medium through combustion of a fuel along with a supply of compressed air; expanding the working medium in a gas turbine; generating steam with heat contained in the expanded working medium; generating hydrogen within the plant by separation from the fuel; combusting the hydrogen with oxygen to produce heat, and superheating the generated steam with the heat from the hydrogen/oxygen combustion; and then delivering the steam to a steam turbine connected into a water/steam circuit.

The invention proceeds from the idea of continuously superheating the superheated steam which is generated in the actual gas-turbine and steam-turbine process, to a temperature of approximately 800° to 1100° C. in a particularly effective way and for this purpose it employs a hydrogen/oxygen steam generator that is known per se.

In a hydrogen/oxygen steam generator which is known, for example, from a publication entitled: "VDI-Bericht Nr. 602" [VDI Report No. 602], 1987, pages 231 to 245, hydrogen and oxygen are introduced into a combustion space and are ignited there through the use of an ignition flame. The combustion gas which occurs and which has a temperature of more than 3000° C. is cooled to the desired steam temperature by the addition of water, and the steam temperature can be adjusted through the use of the mass-flow ratio of injected water to the combustion gas. The steam which is thereby generated is to be used as a split-second reserve (instantaneous reserve) or for peak-load cover for short periods in a steam-turbine plant.

In accordance with another mode of the invention, both the hydrogen necessary for combustion and the oxygen are generated within the process. Thus, the hydrogen for the hydrogen/oxygen combustion is expediently generated by a treatment of the fuel supplied to the gas-turbine and steam-turbine plant. In the case of a gaseous fuel for the gas turbine, for example, this can be part combustion or pre-combustion (partial oxidation) or another suitable method.

The oxygen is expediently generated by the separation of air. Compressed air from the compressor assigned to the gas-turbine plant is advantageously used for this purpose. In the case of a gas-turbine and steam-turbine plant with integrated coal gasification, an air separation plant of this type for generating the oxygen necessary for the coal gasification is already present. In a plant of this type, hydrogen is also already generated within the process.

In accordance with a further mode of the invention, steam is supplied for the hydrogen/oxygen combustion which has been generated in the high-pressure stage of the water/steam circuit of the steam turbine and already superheated there to approximately 500° to 550° C.

In accordance with an added mode of the invention, the fuel for the gas turbine is expediently combusted in two stages.

Thus, the heat occurring during the part combustion of the fuel in a first stage is utilized for steam generation.

In accordance with an additional mode of the invention, the steam so generated is admixed with the steam to be superheated to a high temperature through the use of the hydrogen/oxygen combustion.

With the objects of the invention in view there is also provided a gas and steam turbine plant, comprising a compressor; a gas turbine; a first combustion chamber connected upstream of the gas turbine and connected to the compressor; a steam turbine having a water/steam circuit; a waste-heat steam generator being connected into the water/steam circuit, the waste-heat steam generator having a number of heating surfaces connected into the water/steam circuit; a hydrogen/oxygen burner or steam generator being connected into the water/steam circuit between the waste-heat steam generator and the steam turbine; a second combustion chamber; a fuel-gas conduit connecting the second combustion chamber to the first combustion chamber; and a hydrogen conduit connecting the second combustion chamber to the burner. The second combustion chamber is provided for generating the necessary hydrogen within the process. The fuel used to generate the working medium for the gas turbine is treated in this second combustion chamber with the aim of generating a hydrogen fraction. The fuel treated in the second combustion chamber is supplied through the fuel-gas conduit as fuel gas to the first actual gas-turbine combustion chamber.

In accordance with another feature of the invention, there is provided a heat exchanger which is connected on the primary side into the fuel-gas conduit connected to the second fuel chamber and on the secondary side to the water/steam circuit. This is done in order to ensure that heat occurring in the second combustion chamber during the fuel treatment, that is to say during the part combustion of the fuel, can be utilized for steam generation. At the same time, feed water from the water/steam circuit is expediently supplied to the heat exchanger, and this feed water is first evaporated and subsequently superheated in the heat exchanger.

In accordance with a further feature of the invention, the heat-exchanger is constructed as a waste-heat boiler with a high-pressure evaporator and with a high-pressure super-heater.

In accordance with an added feature of the invention, there is provided a separation apparatus which is connected to the hydrogen conduit opening into the hydrogen/oxygen burner. This is done in order to separate the hydrogen from the fuel gas occurring as a result of the partial combustion of the fuel.

In accordance with a concomitant feature of the invention, the air necessary for the part combustion of the fuel in the second combustion chamber is extracted from the compressor connected to the first combustion chamber.

Other features which are considered as characteristic for the invention are set forth in the appended claims.

Although the invention is illustrated and described herein as embodied in a method for operating a gas and steam turbine plant and a plant working according to the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The FIGURE of the drawing is a schematic circuit diagram of a gas and steam turbine plant with a hydrogen/oxygen burner for superheating generated steam.

DESCRIPTION OF THE PREFERRED EMBODIMENTS

Referring now to the single figure of the drawing in detail there is seen a gas and steam turbine plant 1 which includes a gas-turbine plant with a gas turbine 2 having a coupled air compressor 3 and a first combustion chamber 4 that is located upstream of the gas turbine 2 and is connected to a fresh-air conduit 5 of the air compressor 3. A fuel or fuel-gas conduit 6 opens into the combustion chamber 4 of the gas turbine 2. The gas turbine 2 and the air compressor 3 as well as a generator 7 are seated on a common shaft 8.

The gas and steam turbine plant 1 also includes a steam-turbine plant with a steam turbine 10 having a coupled generator 11 as well as a condenser 13 located downstream of the steam turbine 10 and a waste-heat steam generator 14, in a water/steam circuit 12.

The steam turbine 10 is formed of a high-pressure part **10*a* and a low-pressure part 10*b* which drive the generator 11 through a common shaft 15**.

An exhaust-gas conduit 17 is connected to an inlet **14*a* of the waste-heat steam generator 14 for the supply of working medium A' or flue gas expanded in the gas turbine 2 into the waste-heat steam generator 14. The expanded working medium A' from the gas turbine 2 leaves the waste-heat steam generator 14 through an outlet 14*b*** in the direction of a non-illustrated flue.

The waste-heat steam generator 14 includes heating surfaces in a low-pressure stage of the water/steam circuit 12, namely a preheater 20 and a low-pressure evaporator 22 as well as a low-pressure super-heater 24. The waste-heat steam generator 14 also includes heating surfaces in a high-pressure stage of the water/steam circuit 12, namely a high-pressure evaporator 26 and a high-pressure super-heater 28. The low-pressure super-heater 24 is connected through a steam conduit 30 to the low-pressure part **10*b* of the steam turbine 10. The high-pressure super-heater 28 is connected through a steam conduit 31 to the high-pressure part 10*a* of the steam turbine 10. The low-pressure part 10*b* of the steam turbine 10 is connected on the outlet side through a steam conduit 32 to the condenser 13**.

The water/steam circuit 12 shown in the figure is thus formed of two pressure stages. However, it can also be formed of three pressure stages. In that non-illustrated case, the waste-heat steam generator 14 additionally has a medium-pressure evaporator and a medium-pressure super-heater which are connected into the water/steam circuit 12 and which are connected to a medium-pressure part of the steam turbine 10.

The condenser 13 is connected to the preheater 20 through a condensate conduit 34, into which a condensate pump 36 is connected. Moreover, the condensate conduit 34 is connected to a feed-water tank 44 through a series configuration of three heat exchangers 38, 40 and 42. A conduit 46 connects the outlet side of the preheater 20 to the condensate conduit 34 between the heat exchangers 38 and 40.

The feed-water tank 44 is connected on the outlet side through a feed-water conduit 48 to a water/steam separating vessel 50 of a low-pressure stage. The low-pressure super-heater 24 and the low-pressure evaporator 22 are connected to this vessel 50. Moreover, the feed-water tank 44 is connected on the outlet side to a water/steam separating vessel 54 of a high-pressure stage through a feed-water conduit 51, into which a high-pressure pump 52 is connected. The high-pressure super-heater 28 and the high-pressure evaporator 26 are connected to the vessel 54. Furthermore, a steam conduit 56 connected to the steam conduit 30 opens into the feed-water tank 44 which also works as a degasser.

A hydrogen/oxygen burner 58 is connected into the water/steam circuit 12 between the waste-steam generator 14 and the steam turbine 10. For this purpose, the burner 58 is connected on the inlet side to the outlet of the high-pressure super-heater 28 and on the outlet side to the inlet of the high-pressure part **10*a* of the steam turbine 10. Moreover, an oxygen conduit 60 and a hydrogen conduit 62 open into the hydrogen/oxygen burner 58. The oxygen conduit 60 is connected through the heat exchangers 42 and 40 to an air-separation plant 64. A pump 66 is connected into the oxygen conduit 60 between the heat exchangers 42 and 40 and a pump 68 is connected into the oxygen conduit 60 between the heat exchanger 40 and the gas-separation plant 64. A conduit 69, which is connected through the heat exchanger 38 to the compressor 3, opens into the air-separation plant 64** for the supply of compressed air L.

The hydrogen conduit 62 is connected through a pump 70, a separation apparatus 72 and a waste-heat boiler 74 to a second combustion chamber 76. The combustion chamber 76 is in turn connected through a branch 78 of the fresh-air conduit 5 to the compressor 3. A fuel conduit 80 runs into the combustion chamber 76.

When the gas-turbine and steam-turbine plant is in operation, liquid, gaseous or solid fuel B, for example fuel oil, natural gas or coal from a non-illustrated coal-gasification plant, is supplied to the combustion chamber 76 through the fuel conduit 80. The fuel B is partially combusted in the combustion chamber 76 along with the supply of compressed air L from the compressor 3 and, at the same time, is treated with the aim of also generating a hydrogen fraction in addition to a fuel gas B'. The heat occurring during the part combustion is utilized in the waste-heat boiler or heat exchanger 74 for the generation of steam. For this purpose, the waste-heat boiler 74 has an evaporator 84 and a super-heater 86 as heating or heat-exchange surfaces, which are connected to a water/steam separating vessel 88. Feed water under high pressure from the feed-water tank 44 is supplied to the water/steam separating vessel 88 through a feed-water conduit 90 which is connected to the feed-water conduit 51 on the delivery side of the high-pressure pump 52. The steam which is generated in the evaporator 84 and subsequently superheated in the super-heater 86 on the secondary side is admixed through a conduit 92 with the steam flowing off from the high-pressure super-heater 28, before its introduction into the hydrogen/oxygen burner 58. The pressure of this steam generated by heat exchange with the fuel gas B' corresponds to a pressure $P_H$ of the steam flowing off from the high-pressure super-heater 28.

Through the use of the separation apparatus 72 on the primary side, the hydrogen $H_2$ generated during fuel treatment in the combustion chamber 76 is separated from the cooled fuel gas B' and is supplied to the hydrogen/oxygen burner 58 through the hydrogen conduit 62. The fuel gas B' is supplied to the combustion chamber 4 of the gas turbine 2 and is combusted there with compressed fresh air L from the air compressor 3. The hot working medium A under high pressure which occurs during combustion is expanded in the gas turbine 2 and at the same time drives the gas turbine 2, the air compressor 3 as well as the generator 7. The expanded flue gas or working medium A' emerging from the gas turbine 2 at a temperature $T_A'$, of approximately 600° C. is introduced through the exhaust-gas conduit 17 into the waste-heat steam generator 14 and is used there to generate steam for the steam turbine 10. For this purpose the flue-gas stream and the water/steam circuit 12 are linked to one another in counter-current.

In order to achieve particularly good heat utilization, steam having an enthalpy which is utilized for flow generation in the steam turbine 10, is generated at different pressure levels. Thus, in the low pressure stage, steam with a pressure $P_N$ of approximately 7.5 bar and a temperature $T_N$ of 230° C. can be generated. In the high-pressure stage, steam with a pressure $P_H$ of 80 bar at a temperature $T_H$ of 530° C. can be generated.

While the hydrogen $H_2$ that is necessary for combustion in the burner 58 is obtained from the fuel B, the oxygen $O_2$ is generated in the air-separation plant 64. Thus, the oxygen $O_2$ is separated from the fresh air L that is compressed through the use of the compressor 3. The fraction of oxygen $O_2$ not required for combustion in the burner 58 and nitrogen $N_2$ generated during the separation of air in the air-separation plant 64 can be supplied, for example, to the combustion chamber 4 of the gas turbine 2.

The superheated steam emerging from the high-pressure super-heater 28 of the high-pressure stage, before being introduced into the steam turbine 10, is superheated to a temperature $T'_H$ of higher than 600° C., preferably of approximately 1100° C., through the use of the heat occurring during the combustion of the hydrogen $H_2$ and oxygen $O_2$. At the same time, the steam supplied to the burner 58 cools the hot combustion gas occurring during the hydrogen/oxygen combustion. Furthermore, the pressure $p'_H$ of the steam superheated to high temperature amounts to approximately 80 bar.

The oxygen $O_2$ supplied to the burner 58 is compressed through the use of the pumps 68 and 66 in two stages from a pressure $p_1$ of approximately 2 bar first to a pressure $p_2$ of approximately 20 bar and subsequently to a pressure p3 of approximately 80 bar. In a second and a third stage, through the use of the heat exchangers 40 and 42 respectively, the heat occurring during compression is advantageously utilized for preheating condensate K from the condenser 13 which is supplied to the feed-water tank 44. The heat exchanger 38, in which the heat contained in the compressed fresh air L from the compressor 3 is transmitted to the condensate K, also serves for preheating the condensate in a first stage.

In the same way as the oxygen $O_2$, the hydrogen $H_2$ is also brought to a pressure p4 of approximately 80 bar through the use of the pump 70 before it is introduced into the burner 58.

It is particularly advantageous to use a hydrogen/oxygen burner 58 to generate steam superheated to high temperature in a gas-turbine and steam-turbine plant with integrated coal gasification, since, in a plant of this type, both the hydrogen $H_2$ and the oxygen $O_2$ are usually already generated within the process. A particularly high efficiency of the gas-turbine and steam-turbine plant is achieved as a result of the generation of steam which is superheated to high temperature through the use of the hydrogen/oxygen combustion.

I claim:

1. A method for operating a gas and steam-turbine plant, which comprises:

generating a working medium through combustion of a fuel along with a supply of compressed air;

expanding the working medium in a gas turbine;

generating steam with heat contained in the expanded working medium;

generating hydrogen within the plant by separation from the fuel;

combusting the hydrogen with oxygen to produce heat, and superheating the generated steam with the heat from the hydrogen/oxygen combustion; and then delivering the steam to a steam turbine connected into a water/steam circuit.

2. The method according to claim 1, which comprises generating the oxygen within the plant by separation from the compressed air.

3. The method according to claim 1, which comprises combusting the fuel for the gas turbine in first and second stages, and additionally utilizing heat occurring during part combustion in the first stage for steam generation.

4. The method according to claim 3, which comprises admixing the steam generated during part combustion with the steam to be superheated further through the use of the hydrogen/oxygen combustion.

5. The method according to claim 1, which comprises connecting a low-pressure stage and a high-pressure stage in the water/steam circuit, and superheating the steam generated in the high-pressure stage to a temperature higher than 600° C. through the use of the hydrogen/oxygen combustion.

6. A gas and steam turbine plant, comprising:

a compressor;

a gas turbine;

a first combustion chamber connected upstream of said gas turbine and connected to said compressor;

a steam turbine having a water/steam circuit;

a waste-heat steam generator being connected into said water/steam circuit, said waste-heat steam generator having a number of heating surfaces connected into said water/steam circuit;

a burner for receiving hydrogen and oxygen, said burner being connected into said water/steam circuit between said waste-heat steam generator and said steam turbine;

a second combustion chamber;

a fuel-gas conduit connecting said second combustion chamber to said first combustion chamber; and a hydrogen conduit connecting said second combustion chamber to said burner.

7. The plant according to claim 6, including a heat exchanger having a primary side connected into said fuel-gas conduit and a secondary side connected into said water/steam circuit.

8. The plant according to claim 7, wherein said heat exchanger is a waste-heat boiler having a number of heating surfaces for generating superheated steam under high pressure.

9. The plant according to claim 6, including an apparatus connected to said hydrogen conduit for separating the hydrogen from fuel gas supplied to said first combustion chamber in said fuel-gas conduit.

10. The plant according to claim 6, wherein said second combustion chamber is connected to said compressor.

* * * * *